US005839521A

United States Patent [19]

Dietzen

[11] Patent Number: 5,839,521

[45] Date of Patent: Nov. 24, 1998

[54] OIL AND GAS WELL CUTTINGS DISPOSAL SYSTEM

[76] Inventor: Gary H. Dietzen, 110 Stonewood Cir., Lafayette, La. 70508

[21] Appl. No.: 813,462

[22] Filed: Mar. 10, 1997

Related U.S. Application Data

[63] Continuation-in-part of Ser. No. 729,872, Oct. 15, 1996, which is a continuation-in-part of Ser. No. 416,181, Apr. 4, 1995, Pat. No. 5,564,509, which is a continuation-in-part of Ser. No. 197,727, Feb. 17, 1994, Pat. No. 5,402,857.

[51] Int. Cl.[6] ..... F21B 21/06; B09B 5/00

[52] U.S. Cl. ..... 175/66; 175/206; 175/207

[58] Field of Search ..... 175/66, 206, 207; 166/267; 134/108

[56] References Cited

U.S. PATENT DOCUMENTS

| | | | |
|---|---|---|---|
| D. 296,027 | 5/1988 | Dietzen | D34/39 |
| D. 337,809 | 7/1993 | Dietzen | D23/202 |
| 1,125,413 | 1/1915 | Van Doren . | |
| 2,803,501 | 8/1957 | Kelly | 302/17 |
| 3,400,819 | 9/1968 | Burdyn | 175/66 |
| 3,433,312 | 3/1969 | Burdyn et al. | 175/66 |
| 3,993,359 | 11/1976 | Sweeney | 302/15 |
| 4,019,641 | 4/1977 | Merz | 214/14 |
| 4,030,558 | 6/1977 | Morris | 175/206 X |
| 4,595,422 | 6/1986 | Hill et al. | 175/206 X |
| 4,793,423 | 12/1988 | Knol | 175/66 |
| 4,878,576 | 11/1989 | Dietzen | 198/494 |
| 4,942,929 | 7/1990 | Malachosky et | 175/66 |
| 5,016,717 | 5/1991 | Simons et al | 175/66 |
| 5,109,933 | 5/1992 | Jackson | 175/66 |
| 5,190,085 | 3/1993 | Dietzen | 141/98 |
| 5,322,393 | 6/1994 | Lundquist | 406/38 |
| 5,341,856 | 8/1994 | Appenzeller | 141/67 |
| 5,344,570 | 9/1994 | McLachlan et al. | 175/66 |

FOREIGN PATENT DOCUMENTS

| | | |
|---|---|---|
| 0 005 273 | 5/1979 | European Pat. Off. . |
| 2162880 | 2/1986 | United Kingdom . |

OTHER PUBLICATIONS

Max–Vac Rentals, *Vacuum Skid Unit*, Spec Sheet (With Pictures on Back).

Dresser Industries, Inc., Specifications—*Roots Vacuum Boosters* (Frames 406DVJ Thru 1220DVJ), Feb. 1988.

Dresser Industries, Inc., *Roots DVJ Dry Vacuum Whispair® Blowers*, Nov. 1991.

Dresser Industries, Inc., Specifications—*Roots DVJ Whispair® Dry Vacuum Pumps* (Frames 1016J, 1220J and Larger), Dec. 1992.

Chicago Conveyor Corporation, *Pneumatic Conveying Systems and Specialties*, Brochure.

*Primary Examiner*—Frank Tsay

*Attorney, Agent, or Firm*—Garvey, Smith, Nehrbass & Doody, L.L.C.

[57] ABSTRACT

A method of removing drill cuttings from an oil and gas well drilling platform includes the steps of separating the drill cuttings from the well drilling fluid on the drilling platform so that the drilling fluids can be recycled into the well bore during drilling operations. The cuttings are then transmitted via gravity flow to a materials trough having an interior defined by sidewalls and a bottom portion. The drill cuttings are suctioned from the bottom portion of the trough interior with a pair of primary suction lines, each having an intake portion that is positioned at the materials trough bottom. Drill cuttings are transmitted via the primary suction lines at flow velocities in excess of 100 feet per second to a pair of collection tanks that each have an interior. A vacuum is formed in sequence within the interior of each tank using a blower that is in fluid communication with the tank interior via a vacuum tank and secondary suction lines.

25 Claims, 8 Drawing Sheets

OIL AND GAS WELL CUTTINGS DISPOSAL SYSTEM

CROSS-REFERENCE TO RELATED APPLICATIONS

This is a continuation-in-part of U.S. patent application Ser. No. 08/729,872, filed Oct. 15, 1996, which is a continuation-in-part of U.S. patent application Ser. No. 08/416,181, filed Apr. 4, 1995 (now U.S. Pat. No. 5,564,509) which is a continuation-in-part of U.S. patent application Ser. No. 08/197,727, filed Feb. 17, 1994 (now U.S. Pat. No. 5,402,857), each of which is incorporated herein by reference.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to the disposal of oil and gas well cuttings such as are generated during the drilling of an oil and gas well using a drill bit connected to an elongated drill string that is comprised of a number of pipe sections connected together, wherein a fluid drilling mud carries well cuttings from the drill bit through a well annulus and to a solids removal area at the well head for separating well cuttings from the drilling mud. Even more particularly, the present invention relates to an improved well cuttings disposal system that collects oil and gas well cuttings in a transportable tank that is subjected to a vacuum and which two chambers alternatively and sequentially receive cuttings and separate drilling mud from the cuttings for recycling.

2. General Background

In the drilling of oil and gas wells, a drill bit is used to dig many thousands of feet into the earth's crust. Oil rigs typically employ a derrick that extends above the well drilling platform and which can support joint after joint of drill pipe connected end to end during the drilling operation. As the drill bit is pushed farther and farther into the earth, additional pipe joints are added to the ever lengthening "string" or "drill string". The drill pipe or drill string thus comprises a plurality of joints of pipe, each of which has an internal, longitudinally extending bore for carrying fluid drilling mud from the well drilling platform through the drill string and to a drill bit supported at the lower or distal end of the drill string.

Drilling mud lubricates the drill bit and carries away well cuttings generated by the drill bit as it digs deeper. The cuttings are carried in a return flow stream of drilling mud through the well annulus and back to the well drilling platform at the earth's surface. When the drilling mud reaches the surface, it is contaminated with these small pieces of shale and rock which are known in the industry as well cuttings or drill cuttings.

Well cuttings have in the past been separated from the reusable drilling mud with commercially available separators that are know as "shale shakers". Some shale shakers are designed to filter coarse material from the drilling mud while other shale shakers are designed to remove finer particles from the well drilling mud. After separating well cuttings therefrom, the drilling mud is returned to a mud pit where it can be supplemented and/or treated prior to transmission back into the well bore via the drill string and to the drill bit to repeat the process.

The disposal of shale and cuttings is a complex environmental problem. Drill cuttings contain not only the mud product which would contaminate the surrounding environment, but also can contain oil that is particularly hazardous to the environment, especially when drilling in a marine environment.

In the Gulf of Mexico for example, there are hundreds of drilling platforms that drill for oil and gas by drilling into the subsea floor. These drilling platforms can be in many hundreds of feet of water. In such a marine environment, the water is typically crystal clear and filled with marine life that cannot tolerate the disposal of drill cuttings waste such as that containing a combination of shale, drilling mud, oil, and the like. Therefore, there is a need for a simple, yet workable solution to the problem of disposing of oil and gas well cuttings in an offshore marine environment and in other fragile environments where oil and gas well drilling occurs. Traditional methods of cuttings disposal have been dumping, bucket transport, cumbersome conveyor belts, and washing techniques that require large amounts of water. Adding water creates additional problems of added volume and bulk, messiness, and transport problems. Installing conveyors requires major modification to the rig area and involves many installation hours and very high cost.

SUMMARY OF THE INVENTION

The present invention provides an improved method and apparatus for removing drill cuttings from an oil and gas well drilling platform that uses a drill bit supported with an elongated, hollow drill string. Well drilling fluid (typically referred to as drilling mud) that travels through the drill string to the drill bit during a digging of a well bore.

The method first includes the step of separating well drilling fluid from the waste drill cuttings on the drilling platform so that the drilling fluid can be recycled into the well bore during drilling operations. The drill cuttings fall via gravity from solid separators (e.g. shale shakers) into a material trough. At the material trough, cuttings are suctioned with an elongated suction line having an intake portion positioned in the materials trough to intake well cuttings as they accumulate. In the preferred embodiment, two suction lines are provided. Each suction line has an intake that is positioned to suction cuttings from the materials trough. Each suction line communicates with a cuttings collection tank. A third tank (i.e. a vacuum tank) is positioned in between the vacuum source and the two collection tanks that communicate with the two materials collection lines. The third tank has dual inlets, each receiving a flow line from a respective collection tank. Each inlet is valved so that either one of the collection tanks can be shut off from the vacuum source. In this fashion, one collection tank can be filled at a time. The two collection tanks can be sequentially filled without having to shut the vacuum source down.

The drill cuttings are transmitted via a selected one of the suction lines to a selected one of the collection tanks.

A vacuum is formed within the selected collection tank interior using a blower that is in fluid communication with the tank interior.

Liquids (drilling mud residue) and solids (well cuttings) are separated from the vacuum line at the selected collection tank before the liquids and solids can enter the blower.

The blower is powered with an electric motor drive to reach a vacuum of between about sixteen and twenty-five inches of mercury. Each vacuum line is sized to generate speeds of between about one hundred and three hundred feet per second.

BRIEF DESCRIPTION OF THE DRAWINGS

For a further understanding of the nature and objects of the present invention, reference should be had to the following detailed description, taken in conjunction with the accompanying drawings, in which like parts are given like reference numerals, and wherein.

DETAILED DESCRIPTION OF THE PREFERRED EMBODIMENT

Figure 1:
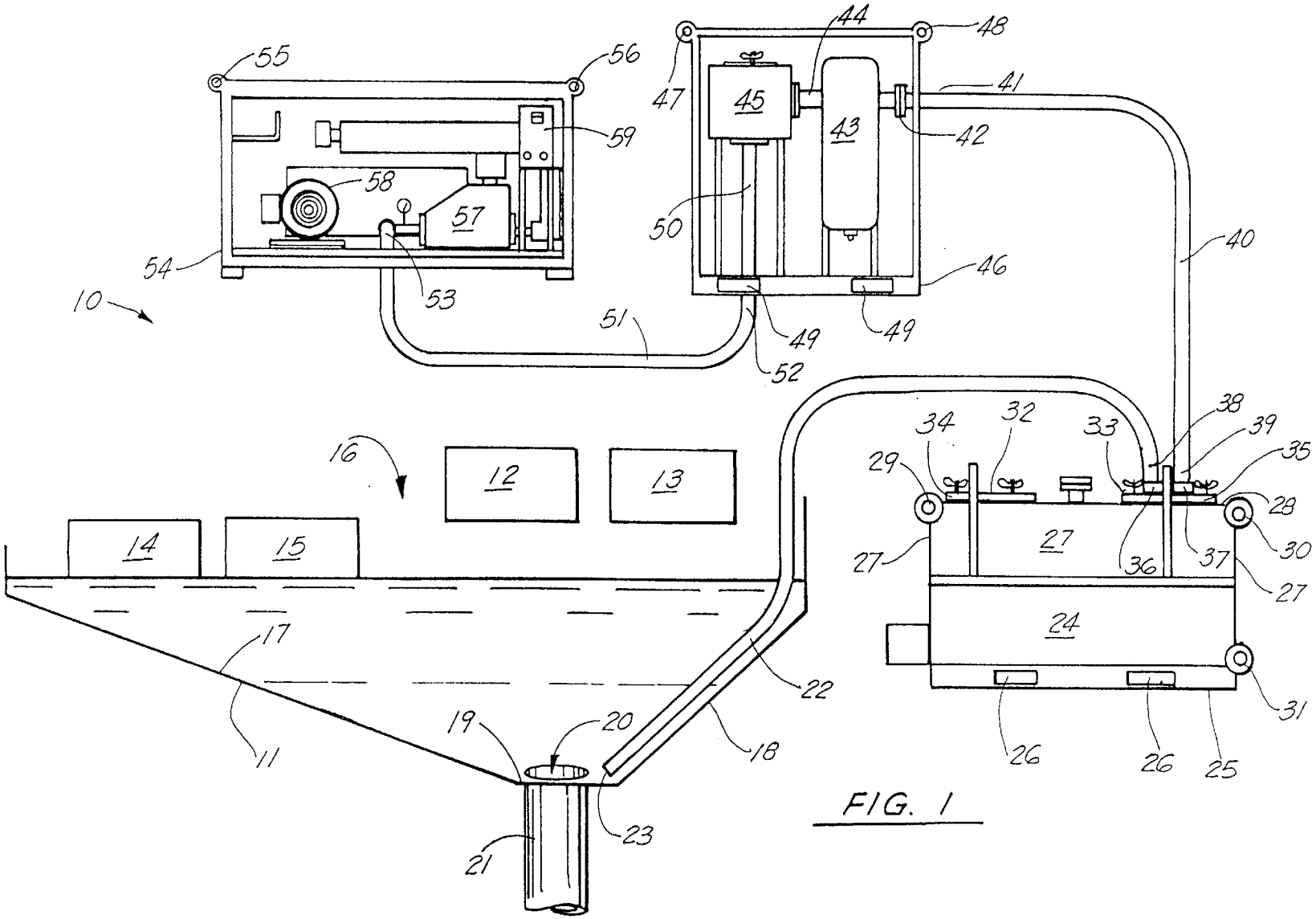
FIG. 1 is a schematic view of the first embodiment of the apparatus of the present invention.

In FIG. 1, there can be seen a first embodiment of the well cuttings disposal system 10 of the present invention. Well cuttings disposal system 10 is used in combination with a material trough that collects solids falling via gravity from a plurality of solids separator units. Material troughs per second are known in the art, typically as a catch basin for cuttings. The material trough 11 defines an area that is a receptacle for solids containing some residual drilling mud. Cuttings have been collected from the well bore after the drilling mud has been transmitted through the drill string to the drill bit and then back to the surface via the well annulus.

At the material trough, there are a plurality of coarse shakers 12, 13 and a plurality of fine shakers 14, 15. The shakers 12, 13, and 14, 15 are commercially available. Coarse shakers 12, 13 are manufactured under and sold under the mark "BRANDT" and fine shakers are sold under the mark "DERRICK". Shakers 12–15 channel away the desirable drilling mud to a mud pit. The well cuttings fall via gravity into trough 11. It is known in the prior art to channel away drilling mud that is to be recycled, and to allow well cuttings to fall from shale shakers via gravity into a receptacle. Such as been the case on oil and gas well drilling rigs for many years.

Interior 16 of trough 11 catches cuttings that have fallen from shakers 12, 15. The trough 11 thus defines an interior 16 having a plurality of inclined walls 17, 18 that communicate with a trough bottom 19. Walls 17, 18 can be Teflon covered to enhance travel of material to bottom 19.

Trough bottom 19 includes a discharge opening 20 that communicates with discharge conduit 21. The opening 20 is typically sealed during operation with a closure plate (not shown).

A first suction line 22 is positioned to communicate with the interior 16 portion of trough 11. First suction line 22 thus provides an inlet 23 end portion and an opposite end portion that communicates with collection tank 24. Tank 24 collects solid material and some liquid (e.g., residual drilling mud on the cuttings) as will be described more fully hereinafter.

Collection tank 24 has a bottom 25, a plurality of four generally rectangular side walls 27, and a generally rectangular top 28. A pair of spaced apart fork lift sockets 26 allow tank 24 to be lifted and transported about the rig floor and to a position adjacent a crane or other lifting device.

A plurality of lifting eyes 29, 31 are provided including eyes 29, 30 on the top of tank 24 and lifting eye 31 on the side thereof near bottom 25.

The lifting eyes 29 and 30 are horizontally positioned at end portions of the tank top 28. This allows the tank to be lifted with a crane, spreader bar, or other lifting means for transferral between a marine vessel such as a work boat and the drilling rig platform. In FIG. 1, the tank 24 is in such a generally horizontal position that is the orientation during use and during transfer between the rig platform and a remote location on shore, for example.

The lifting eyes 30, 31 are used for emptying the tank 24 after it is filled with cuttings to be disposed of. When the tank is to be emptied, a spreader bar and a plurality of lifting lines are used for attachment to lifting eyes 30, 31. This supports the tank in a position that places lifting eye 29 and lifting eye 30 in a vertical line. In this position, the hatch 34 is removed so that the cuttings can be discharged via gravity flow from opening 30 and into a disposal site.

During a suctioning of well cuttings from materials trough 11, the suction line 22 intakes cuttings at inlet 23. These cuttings travel via line 22 to outlet 38 which communicates with coupling 36 of tank 24. Flow takes place from inlet 23 to outlet 38 because a vacuum is formed within the hollow interior of tank 24 after hatches 34, 35 are sealed. The vacuum is produced by using second suction line 40 that communicates via separators 43, 45 with third suction line 51 and blower 57.

Second suction line 41 connects at discharge 39 to coupling 37 of hatch 35. The opposite end of suction line 40 connects at end portion 41 via coupling 42 to fine separator 43. A second fines separator 45 is connected to separator 43 at spool piece 44. The two separators 43 and 45 are housed on a structural separator skid 46 that includes lifting eyes 47, 48 and fork lift sockets 49 for transporting the skid 46 in a manner similar to the transport of tank 24 as aforedescribed.

Third suction line 51 connects to effluent line 50 that is the discharge line from separator 45. End portion 52 of third suction line 51 connects to effluent line 50 at a flange, removable connection for example. The three suction lines 22, 40, 51 are preferably between three and six inches in internal diameter, and are coupled with blower 57 generating about 300–1500 CFM of air flow, to generate flow desired velocities of about 100–300 feet per second that desirably move the shale cuttings through suction line 22. The suction lines are preferably flexible hoses of oil resistant PVC or can be Teflon coated rubber. Quick connect fittings are used to connect each suction line at its ends.

End portion 53 of third section line 51 also connects via a flanged coupling, for example, to blower 57. Blower 57 and its motor drive 58 are contained on power skid 54. Power skid 54 also includes a control box 59 for activating and deactivating the motor drive 58 and blower 57. The power skid 54 provides a plurality of lifting eyes 55, 56 to allow the power skid 54 to be transported from a work boat or the like to a well drilling platform using a lifting harness and crane that are typically found on such rigs.

Each of the units including tank 24, separator skid 46, and power skid 54 can be lifted from a work boat or the like using a crane and transported to the rig platform deck which can be for example 100 feet above the water surface in a marine environment.

Figure 2:
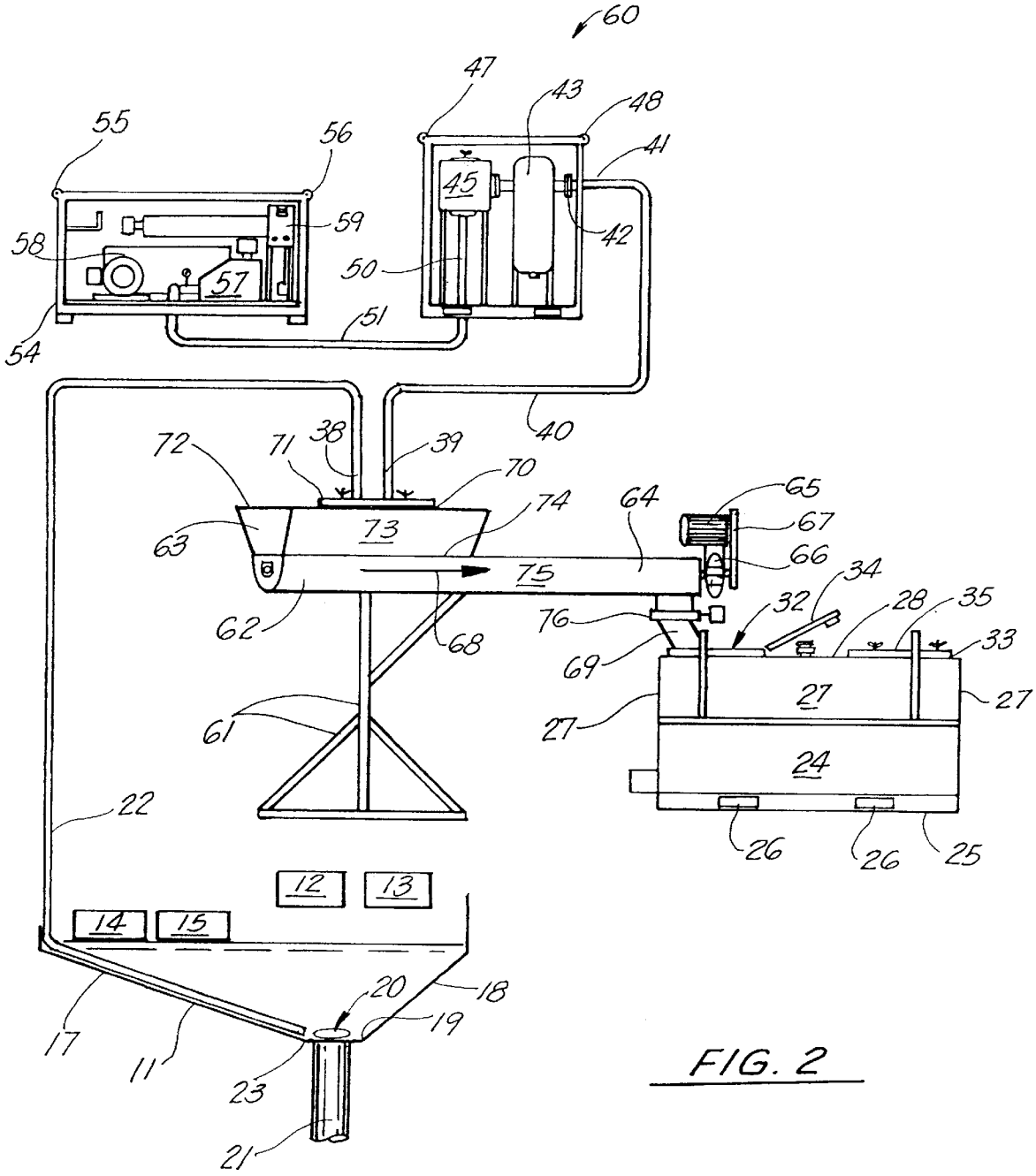
FIG. 2 is a schematic view of a second embodiment of the apparatus of the present invention.

In FIG. 2, a second embodiment of the apparatus of the present invention is disclosed, designated generally by the numeral 60. In FIG. 2, the tank 24 is similarly constructed to that of the preferred embodiment of FIG. 1. However, in FIG. 2, the well cuttings disposal system 60 includes a support 61 that supports a screw conveyor 62 and its associated trough 63. The trough 63 and screw conveyor 62 are sealed at opening 70 in trough 63 using hatch 71. Trough 63 is positioned at an intake end portion of screw conveyor while the opposite end portion of screw conveyor 62 provides a discharged end portion 64 that communicates with discharge shoot 69. Chute 69 empties into opening 32 when hatch 34 is open during use, as shown in FIG. 2.

The screw conveyor 62 is driven by motor drive 65 that can include a reduction gear box 66 for example, and a drive belt 67. Arrow 68 in FIG. 2 shows the flow path of coarse cuttings that are discharged via first suction lines 22 into opening 70 and trough 63. The sidewall and bottom 74 of trough 63 communicate and form a seal with screw conveyor outer wall 75 so that when a vacuum is applied using second suction line 40, cuttings can be suctioned from trough 11 at intake 23 as with the preferred embodiment. The conveyor 62 forcibly pushes the drill cuttings toward discharge end 64. A spring activated door 76 is placed in chute 69. When material backs up above door 76, the door quickly opens under the weight of cuttings in chute 69. Once the cuttings pass door 76, the door shuts to maintain the vacuum inside trough 73, and screw conveyor 62, thus enabling continuous vacuuming.

Figure 3:
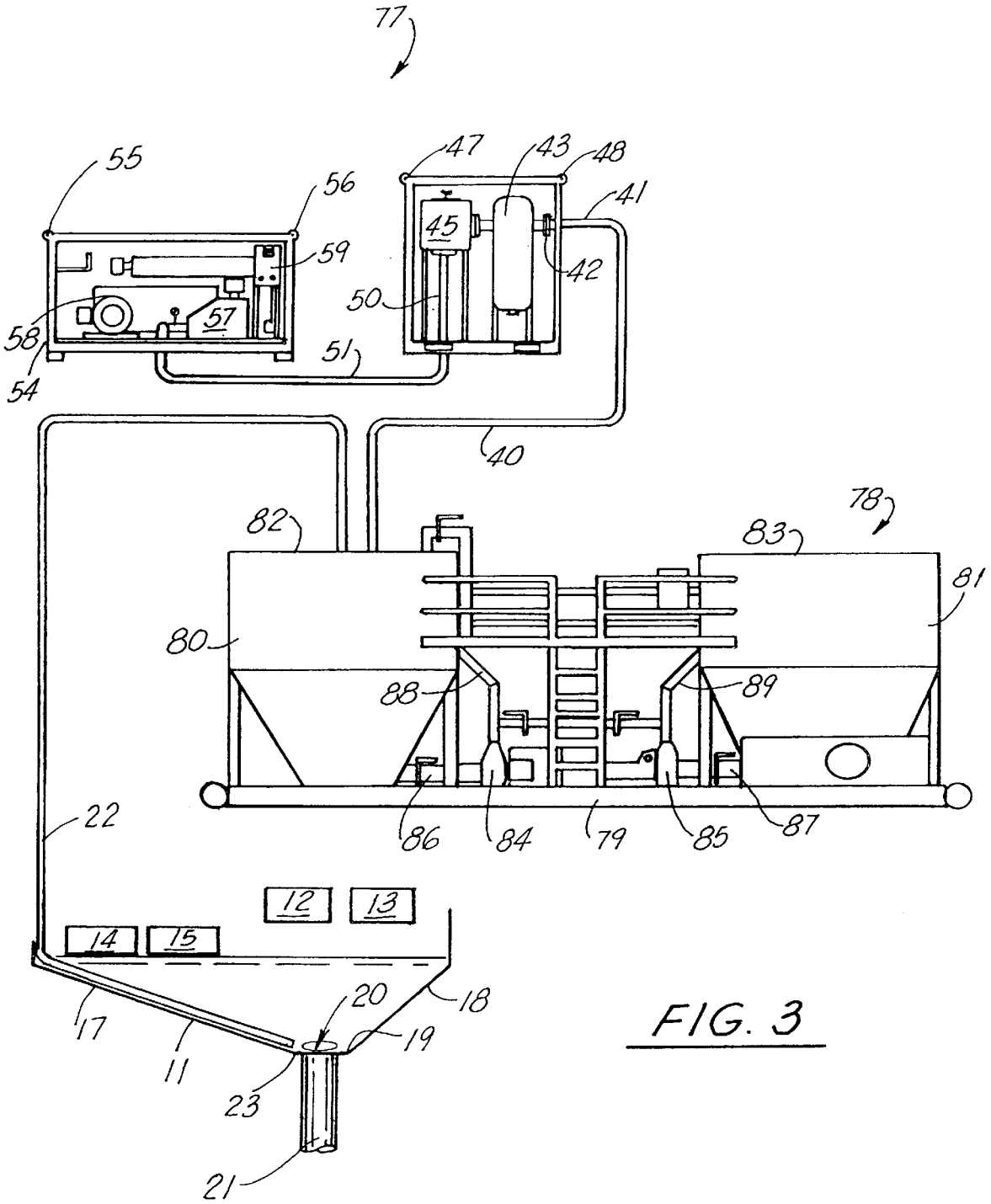
FIG. 3 is a schematic view of a third embodiment of the apparatus of the present invention.

In FIG. 3 there can be seen a third embodiment of the apparatus of the present invention designated generally by the numeral 77. Well disposal cutting system 77 substitutes a slurry unit 78 for collection tank 24 of FIG. 1. Slurry unit 78 has a liftable base frame 79 of welded steel, for example. Upon the frame 79 are positioned a pair of spaced apart vessels 80, 81. Each vessel 80, 81 has a top into which well cuttings can be suctioned in a manner similar to the way in which well cuttings are suctioned into collection tank 24 with the embodiment of FIG. 1. The vessel tops 82, 83 respectively can be provided with openings for connecting the flow lines 22–40 thereto as with the embodiments of FIGS. 1 and 2. The slurry unit 28 provides pumps with impellers (e.g., Mission Magnum fluid centrifugal pump with 75 hp electric motor—5" discharge, 6", suction) for breaking up the cuttings continuously until they form a slurry with a liquid such as water, for example. Pumps 84, 85 have suctioned flow lines 86, 87 respectively and discharge lines 88, 89 respectively. The discharge lines 88, 89 can be seen communicating with the upper end portion of each of the vessels 80, 81 respectively. Likewise, the suction lines 86, 87 communicate with the lower end portion of each of the vessels 80, 81 respectively.

Using the method and apparatus of FIG. 3, a desired volume of cuttings can be suctioned into either one or both of the vessels 80, 81. The pumps 84, 85 are equipped with impellers that can chop up the cuttings into even finer pieces. For example, the pump impellers can have carbide tips that are effective in chopping up and pulverizing the cuttings until a slurry is formed. Each pump 84, 85 respectively continuously recirculates the slurry of cuttings and water between the pump 84, 85 and its respective vessel 80, 81 until a thick viscous slurry is created. A triplex pump (e.g., Gardner Denver) and piping (not shown) can then be used for transmitting the slurried cuttings from the respective vessels 80, 81 downhole, into the well annulus, usually between 2000'–5000' for example, into a porous zone such as a sand zone. In this fashion, the cuttings are disposed of by deep well disposal at the drill site rather than transporting the cuttings to a remote cite such as on shore in the case of a marine based platform.

Figure 4:
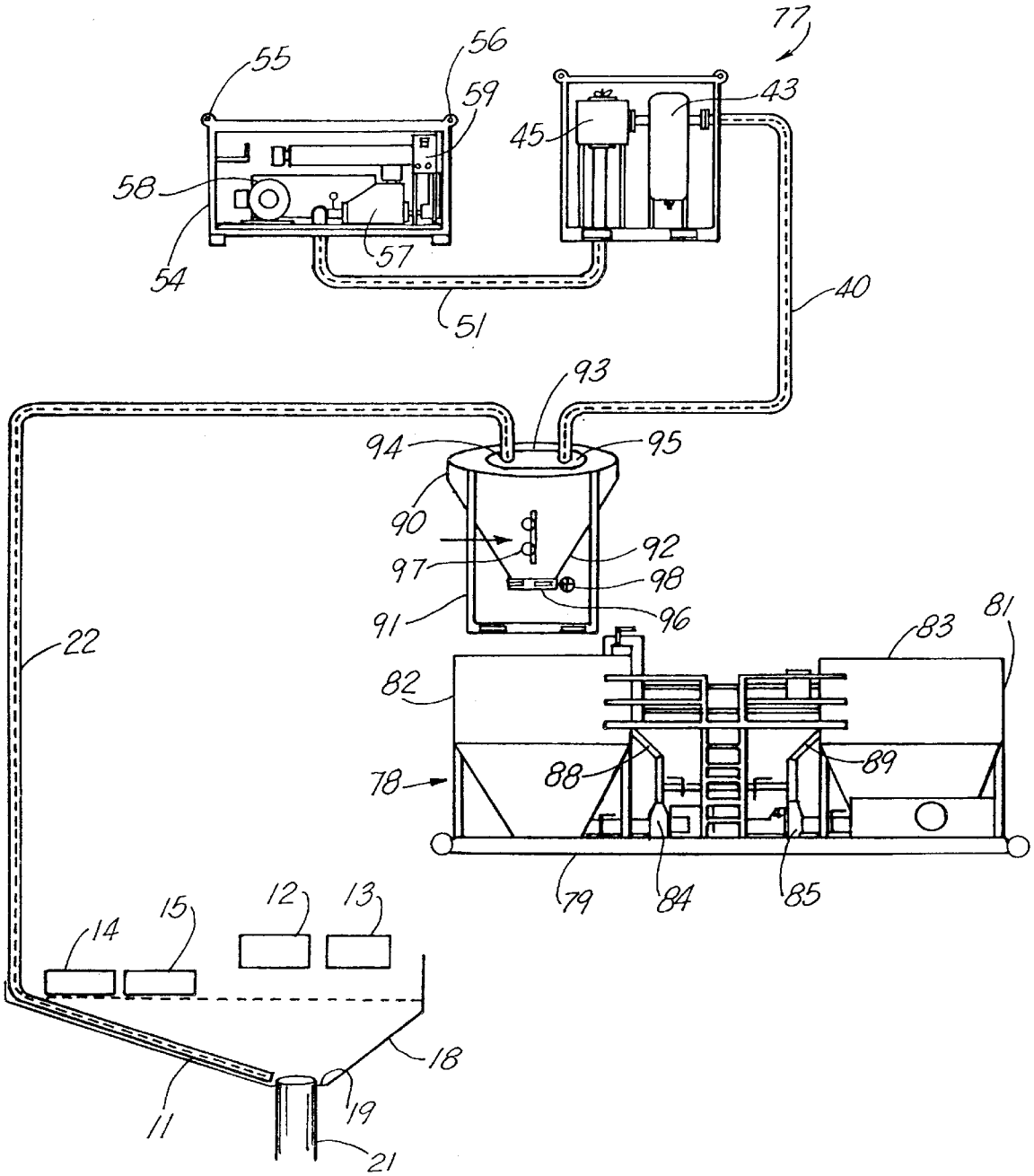
FIG. 4 is a schematic view of the third embodiment of the apparatus of the present invention illustrating the use of a hopper tank in combination with the slurry unit.

In FIG. 4, a hopper tank 90 is shown in combination with the slurry unit 78. Hopper 90 is an optional unit that can be used to receive cuttings from first suction line 22 and to collect the cuttings for batch discharge into slurry unit 78 at intervals. As with the embodiment of FIG. 1, the hopper tank 90 provides a rectangular or circular lid 93 with openings 94, 95 that respectively communicate with vacuum lines 22 and 40.

Hopper tank 90 is preferably supported with a structural liftable frame 91. The tank 90 has a conical wall 92. The upper end portion of tank 90 provides the circular lid 93 while the lower end portion of tank 90 has a discharge outlet 96 controlled by valve 98. Air vibrators 97 can be attached to the conical wall 92 for insuring a complete and smooth discharge of cuttings from within the interior of the hollow hopper tank 90.

Figure 5:
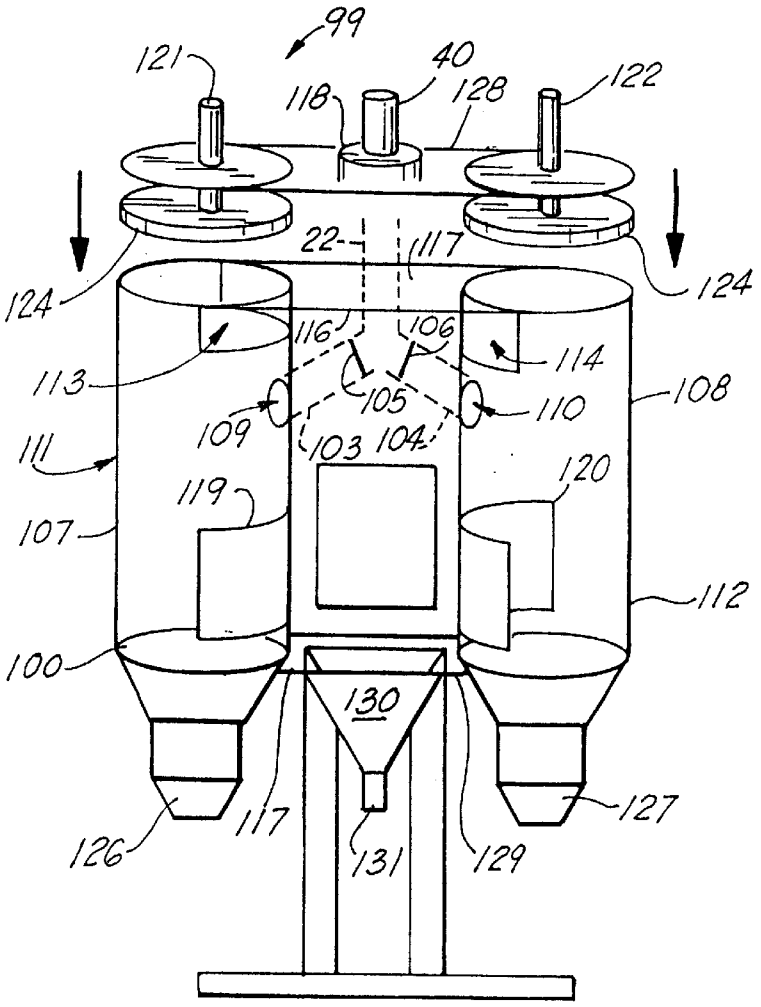
FIG. 5 is an elevational front view of a fourth embodiment of the apparatus of the present invention that utilizes a cuttings squeezer in combination with a vacuum system.
Figure 6:
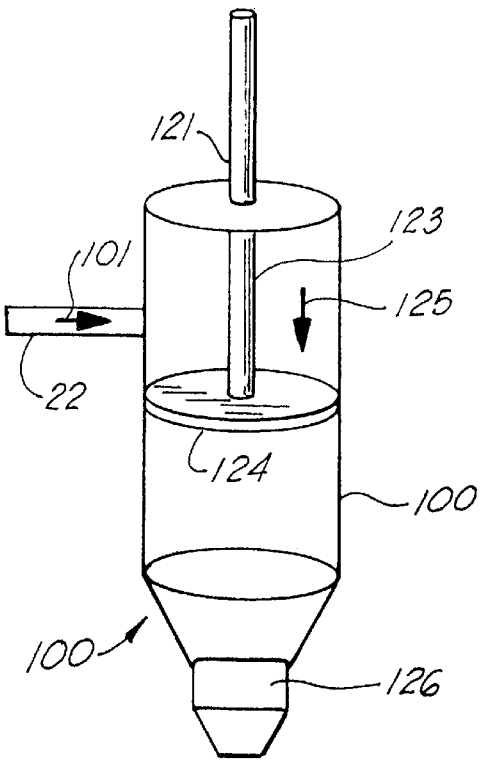
FIG. 6 is a side elevational view of the fourth alternate embodiment of the apparatus of the present invention.

FIGS. 5 and 6 show a fourth embodiment of the apparatus of the present invention designated generally by the numeral 99. In the embodiment of FIGS. 5 and 6, the apparatus shown functions in combination with suction components of FIG. 1 or FIG. 2. In the embodiment of FIGS. 5 and 6, the tank 24 of FIG. 1 is replaced with the cuttings squeezer 100 including its collection cylinders 107, 108, liquid hopper 117, and the associated piping.

In this fashion, the suction line 22 of FIG. 1 communicates with an inlet in the form of a way fitting 102 that carries cuttings from flow line 22 to the way fitting 102 of FIGS. 5 and 6.

The vacuum line 40 of FIGS. 1 and 2 functions as an outlet flow line for suction that communicates with an uppermost outlet fitting 118 on liquid hopper 117.

In the embodiment of FIGS. 5 and 6, the drill cuttings squeezer 100 would thus be used in conjunction with the vacuum system components of FIGS. 1. Instead of material being vacuumed directly into a cutting tank 24 as with FIG. 1 however, material would be suctioned from the cutting trough 11 via flow line 22 to drill cuttings squeezer 100 as shown by arrow 101 in FIG. 5. The vacuum flow line 40 would communicate with outlet fitting 118 of drill cuttings squeezer 100. In the embodiment of FIGS. 5 and 6, the drill cuttings squeezer 100 replaces the tank 24 of FIG. 1.

Way fitting 102 has a pair of branch lines 103, 104 each of which carries a valve 105, 106. Valves 105, 106 can be for example power operated ball valves such as electrically operated or air operated ball valves.

Each branch line 103, 104 communicates with a collection chamber or cylinder 107, 108 respectively. Openings 109, 110 in the collection chamber 107, 108 respectively allow material to flow via line 22 to way fitting 102 and then to either branch line 103 or 104 depending upon which of the ball valves 105, 106 is open or closed.

The valves would preferably be set on automatic timers so that once a particular collection chamber 107 or 108 is full, the valves 105, 106 switch positions to direct material to the other chamber that is not full. When a chamber is full, a hydraulic ram associated with each cylinder pushes material downward and out of the discharge end. Each of the collection chambers 108, 109 is comprised of a cylindrically shaped hollow cylinder having outer wall 111, 112 respectively to provide a hollow interior for holding material that is conveyed to the cylinders 107, 108 via the way fitting 102 and branch lines 103, 104.

At the lower end of each collection cylinder 107, 108 there is provided a screen 119, 120 respectively so that liquid (i.e. drilling fluid) mixed with the drill cuttings can be separated to flow through the screen 119 or 120 into liquid hopper 117. At the upper end of each cylinder 107, 108 a curved air return outlet 113, 114 through the collection cylinder wall 111 or 112 that provides a return line for suction that communicates with outlet fitting 118 and flow line 40.

The liquid hopper 117 thus provides a pair of opposed rectangular plates 115, 116 that can be welded to the wall 111, 112 of the cylinders 107, 108 to form an enclosure in between the cylinders 107, 108. Welded steel plates also seals the hopper 117 at the top and at the bottom. Outlet fitting 118 is an outlet fitting on an upper plate member 128. Likewise, a lower plate 129 carries funnel 130.

At the bottom of the liquid hopper 117, there is provided funnel portion 130 and a liquid outlet 131. In this fashion, liquid can be removed after it has been separated from the cuttings using the hydraulic rams 121, 122 and screen 119, 120 associated with the cylinders 107, 108.

The operation of a single hydraulic ram 121 is shown in FIG. 6. The ram 121 includes a pushrod 123 and a circular plate 124 that fits snugly against the cylindrically shaped wall 111 of collection cylinder 107. As the hydraulic driven ram 121 is operated to force pushrod 123 downwardly in the direction of arrow 125, material below the circular disk 124 is pushed toward the check valve 126. Each of the tanks 107, 108 similarly provides a pushrod 123, circular plate 124, and outlet check valve 126 or 127. The check valve 126, 127 are preferably rubber-like check valves that are commercially available from Red Valve Company for example.

During use, material such as drill cuttings, some drilling mud and the like would be directed into one cylinder 107, 108 or another cylinder 107 or 108 sequentially so that the material could be continuously suctioned via line 22 without having to shut the apparatus down. The valves 105, 106 and hydraulic cylinders 121, 122 would preferably be set on automatic timers so that when a chamber 107 or 108 is full of material, the valves 105, 106 would be either opened or closed to direct material to the other chamber that would be empty. The chambers 107, 108 thus alternate between empty and full condition, one chamber filling is filling while the other is being emptied.

After the material was then directed to the empty chamber, the hydraulic ram 121 or 122 associated with that chamber would begin to push material downward and out of the discharge end via the check valve 126 or 127. As the drill cuttings material and associated drilling fluid is pushed down, it will be compacted and excess fluid squeezed through the screen 119 or 120. Each screen 119 or 120 can be removable and of a selected mesh size depending upon the particular application.

Fluid which passes through a screen 119 or 120 would drain into the hermetically sealed tank 117. Tank 117 is preferably fabricated for example by welding the plates 115 and 116 to opposing sides of the cylinders 107, 108 as shown in FIG. 5 and by similarly welding plates 128, 129 at the top and bottom respectively of the collection cylinders 107, 108 to form an enclosure. In this fashion, the only inlet and outlet on the drill cutting squeezer 100 would be inlet line 22 that communicates with trough 11 and suction outlet line 40 that communicates with separators 43 and 45.

Fluid would drain into the funnel or sump 131 of liquid hopper 117. This collected drilling fluid could then be pumped with a diaphragm pump to transfer the drilling fluid back to the active drilling fluid system of the rig for recycling. Once the hydraulic ram 121 or 122 has pushed material completely out of collection chamber 107 or 108 in the direction of arrow 132, a hydraulic cylinder attached to pushrod 123 would return disk 124 to its upper, starting position at the top of the cylinder 107 or 108 to await the redirecting of material into the cylinder via the branch lines 103, 104 and the openings 109, 110.

In FIGS. 7–10, the fifth and preferred embodiment of the apparatus of the present invention is designated generally by numeral 133. Well cutting disposal system 133 employs two suction lines 134, 135 in the embodiment of FIGS. 7–9. The two suction lines 134, 135 each provide respective inlet portions 136, 137 for intaking well cuttings and associated material that fall into trough 11. Trough 11 would be constructed in accordance with the description of FIG. 1. Thus, trough 11 can include material separation equipment such as coarse shakers, fine shakers and the like. The shakers channel away desirable drilling mud to a mud pit. The well cuttings fall via gravity, for example, into trough 11.

As with the embodiment of FIG. 1, it is known in prior art to channel away drilling mud that is to be recycled and to allow well cuttings to fall from shale shakers, and like separating equipment via gravity into a receptacle such as trough 11. The interior of trough 11 catches cuttings that have fallen from shale shakers and like equipment.

Figure 7:
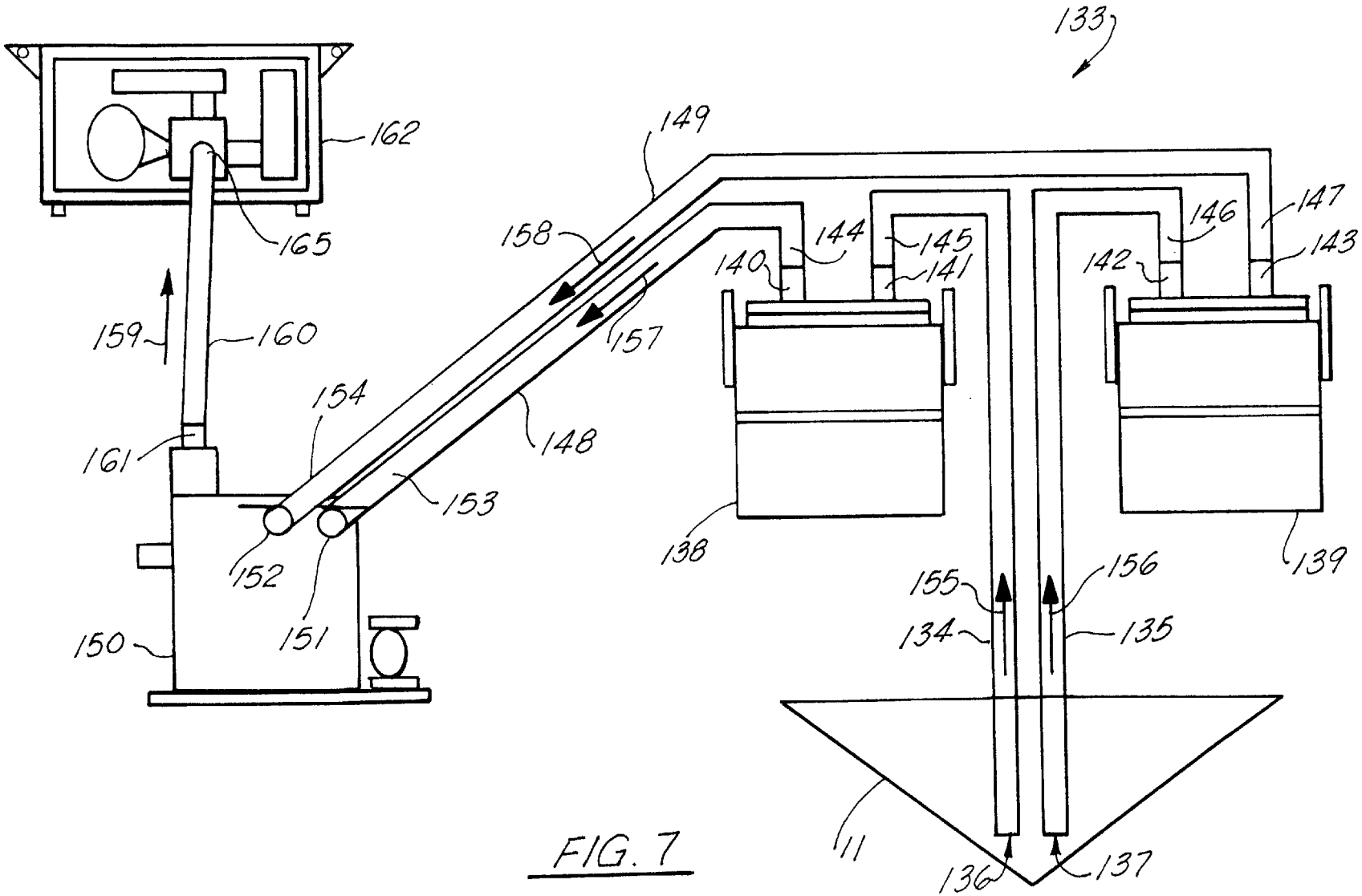
FIG. 7 is a schematic view of a fifth embodiment of the apparatus of the present invention.
Figure 8:
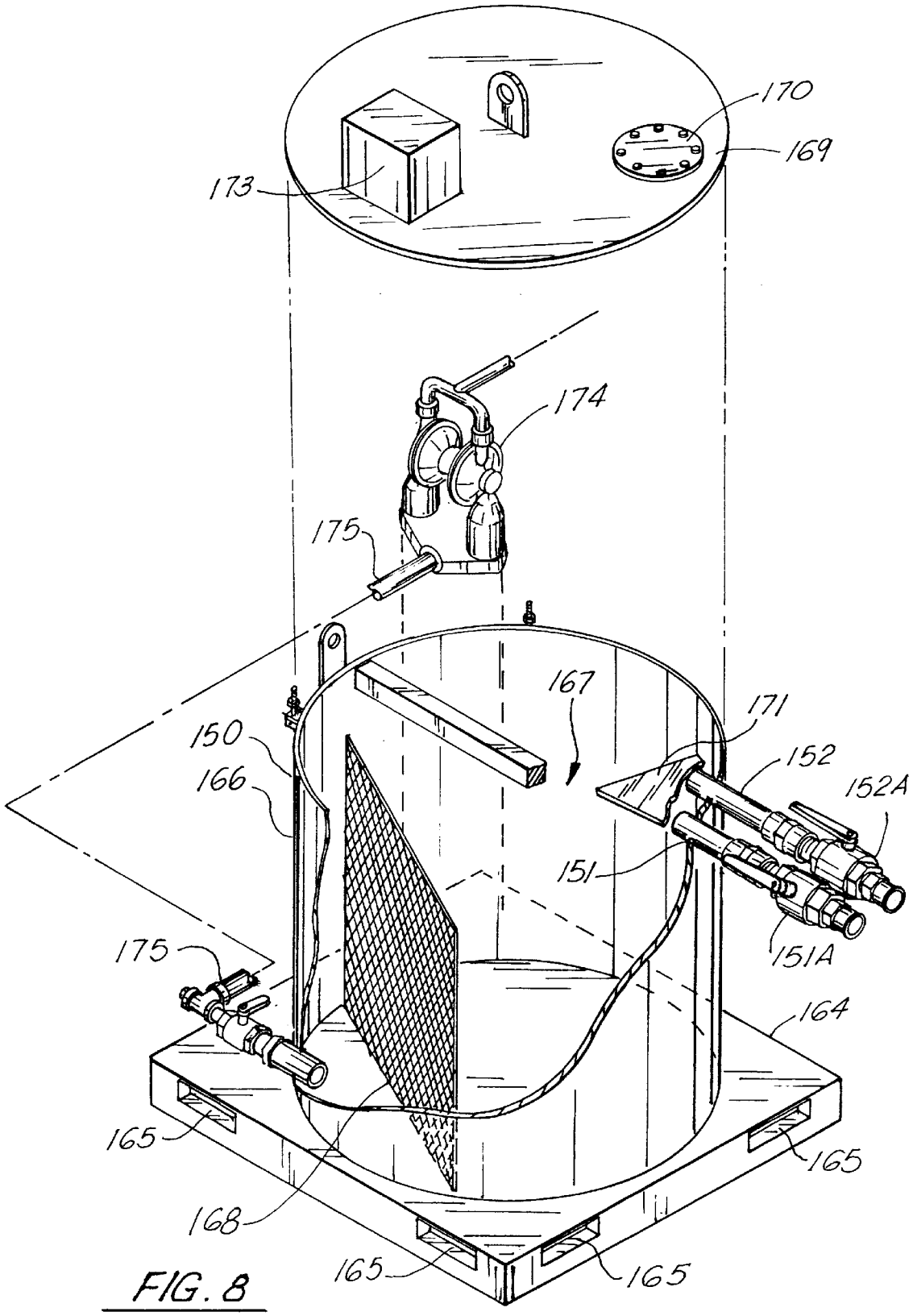
FIG. 8 is a fragmentary perspective view of the fifth embodiment of the apparatus of the present invention illustrating the rig vacuum tank portion thereof.
Figure 9:
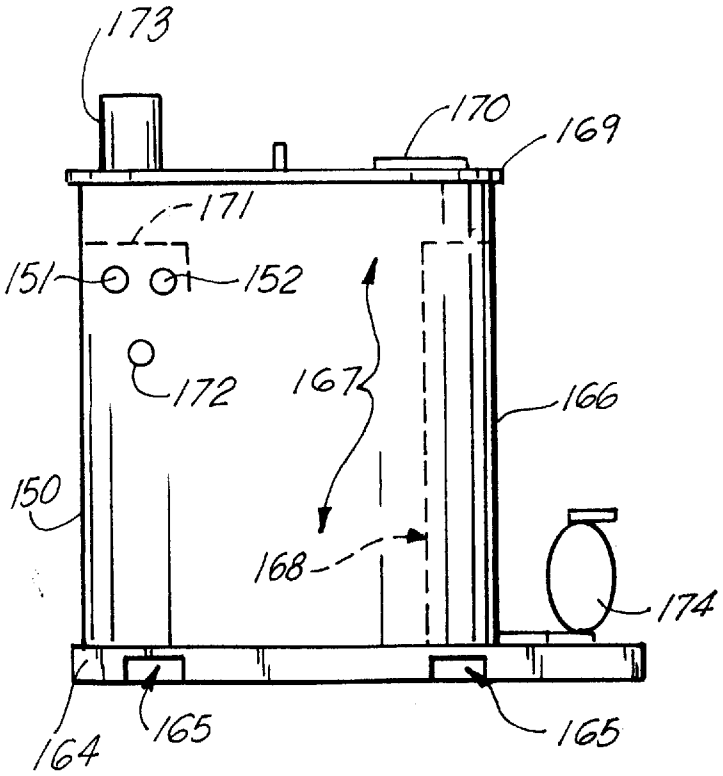
FIG. 9 is a fragmentary side, elevational view of the fifth embodiment of the apparatus of the present invention illustrating the rig vacuum tank portion thereof.

In FIGS. 7–9, the inlet portions 136, 137 occupy the interior of trough 11. This enables either inlet portion 136 or 137 to vacuum cuttings that have fallen into the interior of trough 11. The embodiment of FIG. 1 used a single suction line to remove cuttings from the interior of trough 11. In FIG. 7, two suction lines are used, each with its own collection tank.

In FIG. 7, a pair of collection tanks 138, 139 are provided, each receiving well cuttings that are suctioned with respective suction lines 134, 135. Each collection tank 138, 139 provides fittings for forming connections with end portions of the primary suction lines 134, 135 and with end portions of secondary suction lines 148, 149.

An end portion 145 of suction line 134 forms a connection at inlet fitting 141 with end portion 145. Similarly, inlet fitting 142 forms a connection with end portion 146 of primary suction line 135. Secondary suction line 148 forms a connection at its end portion 144 with outlet fitting 140. Similarly, secondary suction line 149 forms a connection at its end portion 147 with outlet fitting 143. The secondary suction lines 148, 149 form connections at their respective end portions 153, 154 with inlet fittings 151, 152 of rig vacuum tank 150.

Vacuum tank 150 provides an outlet fitting 161 for connection of tertiary suction line 160 thereto. Line 160 conveys air to vacuum skid 162 as shown by the arrow 159 in FIG. 7. The vacuum skid 162 is constructed in accordance with the embodiment of FIGS. 1–6, including for example a blower that is powered with an electric motor to reach a vacuum of between sixteen and twenty-five inches of mercury. In FIG. 1, such a vacuum skid unit is designated as 154 and includes a control box 59 for activating and deactivating the motor drive 58 and blower 57. Vacuum skid 162 can thus be constructed in accordance with power skid 54 in the embodiment of FIG. 1.

During use, the vacuum skid 162 generates a vacuum that communicates with flow line 160 and thus the interior of tank 150. The presence of a vacuum in tank 150 also produces a vacuum in the primary suction lines 134, 135, collection tanks 138, 139, and in the secondary vacuum lines 148, 149. This vacuum produces a suction at inlets 136 and 137 for transmitting cuttings and like material contained in trough 11 to collection tanks 138, 139 via the respective primary suction lines 134, 135. This travel of well cuttings and like material from trough 11 to collection tanks 138 and 139 is indicated by the arrows 155, 156 in FIG. 7.

Material traveling from trough 11 to collection tank 138 travels in primary suction line 134 and enters collection tank 138 at inlet fitting 141. The collection tank 138 communicates with its outlet fitting 140 with secondary suction line 148 and inlet fitting 151 of vacuum tank 150. When tank 138 fills, some material may flow in the direction of arrow 157 from tank 138 into vacuum tank 150. However, the vacuum tank 150 has a level sensor 172 that shuts off vacuum skid 162 should the level of material in tank 150 reach the sensor 172 which is positioned at a level just below inlets 151, 152. In this fashion, neither liquid nor solid material can reach vacuum skid 162.

In practice, the collection tanks 138, 139 are filled in an alternating, sequential fashion. This is made possible by valves 151A, 152A that are respectively placed at fittings 151, 152. The operator simply closes the valve at fitting 152 when the valve at 151 is open and tank 138 is being filled. This closure of a valve at fitting 152 shuts off any vacuum from secondary flow line 149 and primary flow line 135 to tank 139. Thus the tank 138 preliminarily fills until the valve 152A at fitting 152 is opened and the valve 151A at fitting 151 is closed.

In this manner, an operator can continuously suction cuttings from trough 11. This is important when well drilling activity is at a peak and the trough 11 is receiving a continuous flow of cuttings from shale shakers and like equipment. By alternating the vacuum to tank 138 or tank 139, the well cuttings disposal system 133 of the present invention can function continuously. When a tank 138 or 139 is filled, suctioning simply switches to the other tank so that the filled tank 138 or 139 can be removed and a new tank can be put in its place. If fluid or other material in tank 150 reaches sensor 172, the vacuum skid 162 can be automatically shut off. However, the sensor 172 can also operate a diaphragm discharge pump 174 for emptying the contents of vacuum tank 150.

Figure 10:
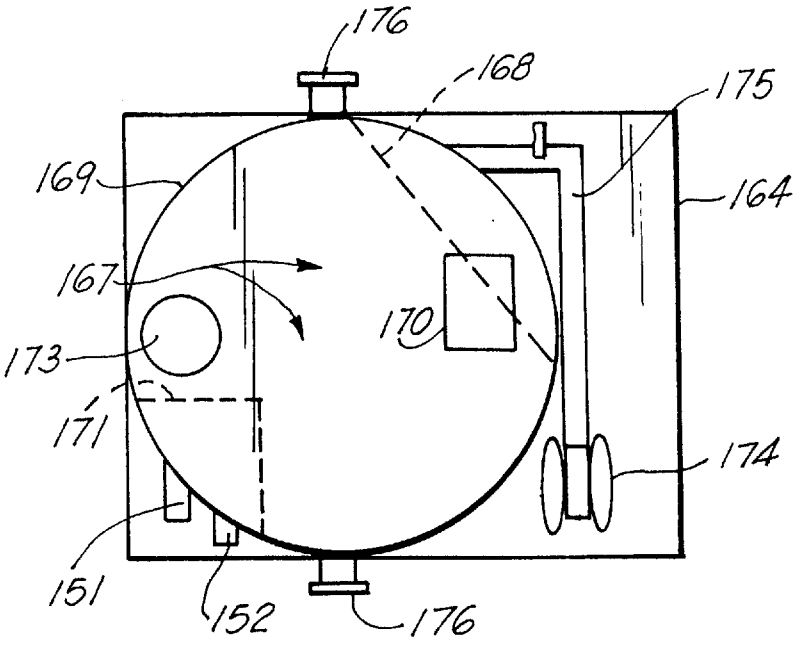
FIG. 10 is a top fragmentary view of the fifth embodiment of the apparatus of the present invention illustrating the rig vacuum tank portion thereof.

FIGS. 8–10 show more particularly the construction of rig vacuum tank 150. Tank 150 has a base 164 with a pair of space-to-part sockets 165 for receiving fork lift tines that can lift and transport tank 150. The tank 150 has a cylindrical wall 166 with a hollow tank interior 167. Screen 168 is placed on the inside 167 of tank 150 and functions to prevent debris from getting into diaphragm discharge pump 174. Tank 150 has a removable lid 169 that carries an inspection hatch 170 and a separator 173. The entire lid 169 is removable for easy cleaning of tank 150 should such cleaning be required.

Separator 173 removes any fluids in the air stream that flows through lines 160 to vacuum skid 162. Deflector plate 171 is positioned on the inside 167 of tank 150 for deflecting material that enters tank interior 167 via inlet fittings 151, 152. Discharge pump 174 communicates with tank interior via flow line 175.

The following table lists the parts numbers and parts descriptions as used herein and in the drawings attached hereto.

PARTS LIST

| Part Number | Description |
|---|---|
| 10 | well cuttings disposal system |
| 11 | material trough |
| 12 | coarse shaker |
| 13 | coarse shaker |
| 14 | fine shaker |
| 15 | fine shaker |
| 16 | reservoir |
| 17 | inclined wall |
| 18 | inclined wall |
| 19 | trough bottom |
| 20 | discharge opening |
| 21 | conduit |
| 22 | first suction line |
| 23 | inlet |
| 24 | collection tank |
| 25 | bottom |
| 26 | fork lift socket |
| 27 | side wall |
| 28 | top |
| 29 | lifting eye |
| 30 | lifting eye |
| 31 | lifting eye |
| 32 | opening |
| 33 | opening |
| 34 | hatch |
| 35 | hatch |
| 36 | coupling |
| 37 | coupling |
| 38 | outlet |
| 39 | discharge |
| 40 | second suction line |
| 41 | end |
| 42 | coupling |
| 43 | separator |
| 44 | spool piece |
| 45 | separator |
| 46 | separator skid |
| 47 | lifting eye |
| 48 | lifting eye |
| 49 | fork lift socket |
| 50 | effluent line |
| 51 | third suction line |
| 52 | end |
| 53 | end |
| 54 | power skid |
| 55 | lifting eye |
| 56 | lifting eye |
| 57 | blower |
| 58 | motor drive |
| 59 | control box |
| 60 | well cuttings disposal system |
| 61 | support |
| 62 | screw conveyor |
| 63 | trough |
| 64 | discharge end portion |
| 65 | motor drive |
| 66 | gearbox |
| 67 | drive belt |
| 68 | arrow |
| 69 | discharge chute |
| 70 | opening |
| 71 | hatch |
| 72 | top |
| 73 | side wall |
| 74 | bottom |
| 75 | screw conveyor outer wall |
| 76 | spring loaded door |

-continued

PARTS LIST

| Part Number | Description |
|---|---|
| 77 | well cuttings disposal unit |
| 78 | slurry unit |
| 79 | frame |
| 80 | vessel |
| 81 | vessel |
| 82 | top |
| 83 | top |
| 84 | pump |
| 85 | pump |
| 86 | flow line |
| 87 | flow line |
| 88 | flow line |
| 89 | flow line |
| 90 | hopper tank |
| 91 | liftable frame |
| 92 | conical wall |
| 93 | circular lid |
| 94 | opening |
| 95 | opening |
| 96 | outlet |
| 97 | air vibrator |
| 98 | valve |
| 99 | cutting system |
| 100 | drill cuttings squeezer |
| 101 | arrow |
| 102 | wipe fitting |
| 103 | branch line |
| 104 | branch line |
| 105 | valve |
| 106 | valve |
| 107 | collection cylinder |
| 108 | collection cylinder |
| 109 | inlet opening |
| 110 | inlet |
| 111 | wall |
| 112 | wall |
| 113 | opening |
| 114 | opening |
| 115 | plate |
| 116 | plate |
| 117 | liquid hopper |
| 118 | outlet fitting |
| 119 | screen |
| 120 | screen |
| 121 | ram |
| 122 | ram |
| 123 | pushrod |
| 124 | circular plate |
| 125 | arrow |
| 126 | check valve |
| 127 | check valve |
| 128 | upper plate member |
| 129 | lower piate member |
| 130 | funnel |
| 131 | outlet |
| 132 | arrow |
| 133 | well cuttings disposal system |
| 134 | primary suction line |
| 135 | primary suction line |
| 136 | inlet portion |
| 137 | iniet portion |
| 138 | collection tank |
| 139 | collection tank |
| 140 | outlet fitting |
| 141 | inlet fitting |
| 142 | inlet fitting |
| 143 | outlet fitting |
| 144 | end portion |
| 145 | end portion |
| 146 | end portion |
| 147 | end portion |
| 148 | secondary suction line |
| 149 | secondary suction line |
| 150 | rig vacuum tank |
| 151 | inlet |
| 151A | valve |

-continued

PARTS LIST

| Part Number | Description |
|---|---|
| 152 | inlet |
| 152A | vaive |
| 153 | end portion |
| 154 | end portion |
| 155 | arrow |
| 156 | arrow |
| 157 | arrow |
| 158 | arrow |
| 159 | arrow |
| 160 | flow line |
| 161 | outlet fitting |
| 162 | vacuum skid |
| 163 | inlet fitting |
| 164 | base |
| 165 | socket |
| 166 | cylindrical wall |
| 167 | tank interior |
| 168 | screen |
| 169 | lid |
| 170 | inspection hatch |
| 171 | deflector plate |
| 172 | fluid level sensor |
| 173 | separator |
| 174 | discharge pump |
| 175 | flow line |
| 176 | lifting eye |

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as invention is:

1. A method of removing drill cuttings from an oil and gas well drilling platform that uses a drill bit supported with a drill string and a well drilling fluid during a digging of a well bore, comprising the steps of:

a) separating drill cuttings from the well drilling fluid on the drilling platform so that the drilling fluids can be recycled into the well bore during drilling operations;

b) transmitting the cuttings to a materials trough having an interior;

c) suctioning the separated drill cuttings with a suction line having an intake end portion that can be positioned at the materials trough;

d) transmitting the drill cuttings via the suction line to a pair of tanks that each have an interior and at least one access opening for communicating with the tank interior;

e) sequentially forming a vacuum within the holding tank interiors with a blower that is in fluid communication with each tank interior; and f) using a third tank to selectively control the vacuum within the tank interiors.

2. The method of claim 1 wherein in step "d", the third tank has two valve portions and wherein the holding tank interior portions are filled and emptied in an alternating sequence by controlling the valves.

3. The method of claim 1 wherein the flow velocity in the suction line is about one hundred to three hundred (100–300) feet per second.

4. The method of claim 1 further comprising the step of separating residual drilling fluid from drill cuttings within the holding tanks.

5. The method of claim 1 wherein liquids and solids are separated from the suction line at the holding tank and liquids and solids are separated from the second suction line at the third tank positioned in fluid communication with a second vacuum line upstream of the blower.

6. The method of claim 1 wherein the blower generates fluid flow in the vacuum lines of between about three hundred and fifteen hundred (300–1500) cubic feet per minute.

7. The method of claim 1 wherein the vacuum formed within each holding tank is between about sixteen and twenty-five (16–27) inches of mercury.

8. An oil well drill cuttings disposal apparatus comprising:

a) a pair of holding tanks for collecting drill cuttings to be disposed of, each of said tanks having an interior collection chamber, each with a holding tank inlet opening that allows material to be added to each holding tank, and holding tank outlets that enable a selected tank interior to be emptied when the vacuum on a chamber is relieved;

b) a pair of suction lines for transmitting cuttings from the drill site to respective inlet openings of the holding tanks;

c) a power source for forming a vacuum within a selected one of the tank interiors and comprising a blower and an electric motor drive for powering said blower;

d) a rig vacuum tank having a pair of vacuum tank inlet fittings and a vacuum tank outlet fitting;

e) a pair of flow lines extending from the outlet fittings to the rig vacuum tank inlet fittings; and f) control valves for controlling flow into the vacuum tank interior via the inlet fittings.

9. The apparatus of claim 8 wherein the suction lines include flexible hoses.

10. The apparatus of claim 8 wherein the valves enable a user to direct well cuttings to one of the holding tanks.

11. The apparatus of claim 8 wherein the valves continuously direct cuttings to one of the holding tanks so that the other holding tank can be emptied.

12. The apparatus of claim 8 wherein the vacuum tanks is positioned in between the power source and the holding tanks in a suction line so that the vacuum tank defines a second separator.

13. The apparatus of claim 8 wherein each of the holding tanks and power source are separate, transportable units.

14. The apparatus of claim 12 wherein the holding tanks and vacuum tanks are each mounted on separate transportable frames.

15. A method of removing drill cuttings from an oil and gas well drilling platform that uses a drill bit supported with a drill string and a well drilling fluid during a digging of a well bore, comprising the steps of:

a) separating drill cuttings from the well drilling fluid on the drilling platform so that the drilling fluids can be recycled into the well bore during drilling operations;

b) transmitting the cuttings to a materials trough having an interior;

c) suctioning the separated drill cuttings with first and second suction lines, each having an intake end portion that can be positioned at the materials trough;

d) transmitting the drill cuttings via a selected one of the suction lines to a selected collection tank of a pair of collection tanks in an alternating fashion so that one tank can be filling while the other tank can be emptied or replaced;

e) forming a vacuum within the interior of the selected collection tank using a blower that is in selective fluid communication with each tank interior via vacuum lines;

f) separating liquids and solids from the vacuum lines before said liquids and solids can enter the blower; and g) valving the flow of fluid between the materials trough and the blower with a vacuum tank positioned in between the blower and the pair of collection tanks.

16. The method of claim 15 wherein in step "d", the collection tanks are filled and emptied in an alternating sequence.

17. The method of claim 15 wherein the flow velocity in the first suction line is about one hundred to three hundred (100–300) feet per second.

18. The method of claim 15 wherein liquids and solids are separated from the suction lines at the collection tanks.

19. The method of claim 15 wherein in step "e", the blower generates fluid flow in the vacuum lines of between about three hundred and fifteen hundred (300–1500) cubic feet per minute.

20. The method of claim 15 wherein the vacuum formed within the collection tanks is between about sixteen and twenty-seven (16–27) inches of mercury.

21. An oil well drill cuttings disposal apparatus comprising:

a) a pair of collection tanks for collecting drill cuttings to be disposed of, each said tank apparatus having an interior that allows material to be added to the tank apparatus, and outlets that enable each tank to be emptied;

b) a pair of primary suction lines for transmitting cuttings from the drill site to one of the collection tanks;

c) a blower for forming a vacuum within a selected one of the collection tanks;

d) a rig vacuum tank;

e) a pair of secondary suction lines for communicating between the interior of the collection tanks and the vacuum tanks;

f) the collection tanks defining separators that are positioned in between the primary and secondary suction lines for preventing the travel of solid and liquid matter from the collection tanks to the vacuum tank; and g) the vacuum tanks having a pair of fittings for controlling vacuum generated by the blower so that a vacuum can be generated in either of the collection tanks so that the drill cuttings can be vacuumed to one collection tank or the other in alternating fashion.

22. The apparatus of claim 21 wherein the suction lines are flexible hoses.

23. The apparatus of claim 21 further comprising a flow control apparatus for directing well cuttings to a selected one of the collection tanks at a time.

24. The apparatus of claim 23 wherein the flow control apparatus continuously directs cuttings to one collection tank or the other so that cuttings can be continuously vacuumed.

25. The apparatus of claim 21 further comprising a valve associated with each collection tank for directing vacuum to one collection tank or the other.

* * * * *